US011976526B2

(12) United States Patent
Patterson

(10) Patent No.: US 11,976,526 B2
(45) Date of Patent: May 7, 2024

(54) PERTURBATION BASED WELL PATH RECONSTRUCTION

(71) Applicant: HALLIBURTON ENERGY SERVICES, INC., Houston, TX (US)

(72) Inventor: Daniel Luther Patterson, East Tawakoni, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 1174 days.

(21) Appl. No.: 16/608,889

(22) PCT Filed: Dec. 31, 2018

(86) PCT No.: PCT/US2018/068181
§ 371 (c)(1),
(2) Date: Oct. 28, 2019

(87) PCT Pub. No.: WO2020/142080
PCT Pub. Date: Jul. 9, 2020

(65) Prior Publication Data

US 2021/0332654 A1 Oct. 28, 2021

(51) Int. Cl.
*E21B 23/00* (2006.01)
*E21B 19/24* (2006.01)

(52) U.S. Cl.
CPC ..... *E21B 23/00* (2013.01); *E21B 19/24* (2013.01)

(58) Field of Classification Search
CPC ..... E21B 23/00; E21B 19/24
See application file for complete search history.

(56) References Cited

U.S. PATENT DOCUMENTS 2,333,802 A 11/1943 Lowrey
3,073,134 A * 1/1963 Mann ..... E21B 17/07 166/243

(Continued)

FOREIGN PATENT DOCUMENTS

CN 104314501 A 1/2015
CN 204941413 U 1/2016

(Continued)

OTHER PUBLICATIONS

International Search Report and Written Opinion; PCT Application No. PCT/US2018/068181; dated Sep. 27, 2019.

(Continued)

*Primary Examiner* — Blake Michener
*Assistant Examiner* — Neel Girish Patel
(74) *Attorney, Agent, or Firm* — NOVAK DRUCE CARROLL LLP

(57) ABSTRACT

A guide having a tubular body with an inner and outer sleeve each coupled with the tubular body at their uphole end and a downhole end having a slanted face, each of the inner and outer sleeves being slideable relative one another. A hydraulic is formed between each of the first and second sleeves and containing a hydraulic fluid. The first and second sleeves are transitionable between a first configuration and a second configuration, wherein in the first configuration the downhole end of the second sleeve is extended beyond the downhole end of the first sleeve, and in the second configuration the downhole end of the first sleeve is extended beyond the lower end of the second sleeve. The slanted face of each of the first sleeve and the second sleeves oriented facing different circumferential directions to facilitate engagement with a downhole tool.

17 Claims, 5 Drawing Sheets

(56) References Cited

U.S. PATENT DOCUMENTS

| | | | | |
|---|---|---|---|---|
| 4,312,965 | A | 3/1982 | Restarick et al. | |
| 4,321,965 | A * | 3/1982 | Restarick | E21B 31/14 166/240 |
| 4,398,756 | A * | 8/1983 | Duret | E21B 17/042 285/334 |
| 5,584,353 | A * | 12/1996 | Chancey | E21B 31/113 166/178 |
| 7,513,302 | B2 * | 4/2009 | Cassidy | E21B 41/0035 166/117.6 |
| 2006/0124306 | A1 * | 6/2006 | Vail, III | E21B 33/14 175/57 |
| 2006/0207769 | A1 * | 9/2006 | Corbett | E21B 33/10 166/380 |
| 2008/0156479 | A1 * | 7/2008 | Cassidy | E21B 23/12 166/117.5 |
| 2009/0056947 | A1 * | 3/2009 | Du | H01R 13/533 439/255 |
| 2009/0145605 | A1 * | 6/2009 | Kratochvil | E21B 31/107 166/243 |
| 2011/0168406 | A1 * | 7/2011 | Du | E21B 19/16 166/380 |
| 2013/0068472 | A1 * | 3/2013 | Lauderdale | E21B 34/142 166/334.1 |
| 2017/0356260 | A1 | 12/2017 | Arroba | |
| 2021/0355811 | A1 * | 11/2021 | Patterson | E21B 47/024 |

FOREIGN PATENT DOCUMENTS

| | | | |
|---|---|---|---|
| CN | 107587850 | A | 1/2018 |
| GB | 2445439 | A | 7/2008 |

OTHER PUBLICATIONS

English abstract of CN107587850; retreived from www.espacenet.com on Oct. 17, 2019.

Quantum Self-Aligning Guide Shoe; https://www.slb.com/~/media/Files/completions/product_sheets/packer_accessories/quantum_self_aligning_guide_shoe.pdf.

Office Action; Chinese Application No. 201880099233.8; dated Dec. 2, 2022.

English abstract of CN204941413; retrieved from www.espacenet.com on Dec. 27, 2022,.

English abstract of CN104314501; retrieved from www.espacenet.com on Dec. 27, 2022.

Search Report & Written Opinion; Singapore Application No. 11202101326V; dated Jul. 20, 2022.

Examination Report; Malaysian Application No. PI 2021000657; dated Feb. 26, 2023.

* cited by examiner

PERTURBATION BASED WELL PATH RECONSTRUCTION

CROSS-REFERENCE TO RELATED APPLICATIONS

This application is a national stage entry of PCT/US2018/068181 filed Dec. 31, 2018, said application is expressly incorporated herein in its entirety.

FIELD

The present disclosure relates to a guide for a tubular string, and in particular a guide for facilitating coupling of a tubular string with downhole tools.

BACKGROUND

During the course of hydrocarbon exploration and production one or more downhole tools may be lowered into a wellbore in order to carry out specific tasks, for instance, packers may be lowered into a wellbore to isolate particular zones of interest. These downhole tools may be lowered on a tubular string and positioned at a desired location in the wellbore and thereafter the tubular string withdrawn to the surface. Such downhole tools may thereafter require activation or extraction from the wellbore.

In order to access such downhole tools, a tubular string is inserted into the wellbore with its end lowered until reaching and engaging the downhole tool. Generally, the downhole tools may have an engagement surface, such as an entrance hole, at its upper end which may receive the lower end of the tubular string. A difficulty may arise however in that rather than entering the entrance hole of the downhole tool, the lower end of the downhole tool may become lodged on top of the edge of the entrance hole. One reason for this is, as the tubular string is lowered, the entrance hole of the downhole tool may be centered, whereas the tubular string may not be along the surface of the wellbore (or casing) rather than centered.

In order to counter such issues, tubular strings have been provided with a guide on its lower end which may have a face slanted at an angle, such as 45 degrees. These lower end guides may be referred to as "mule shoes" in the field. As the lower face is provided at an angle, when engaging an edge of an entrance hole of a downhole tool, the angled face may cause the tubular string to slide into the entrance hole rather than become lodged. However, as the face is at a 45 degree angle, the tubular string may require rotation so as to place the angled face in proper orientation such that it slides against the edge rather becoming lodged on the edge of the entrance hole.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1:
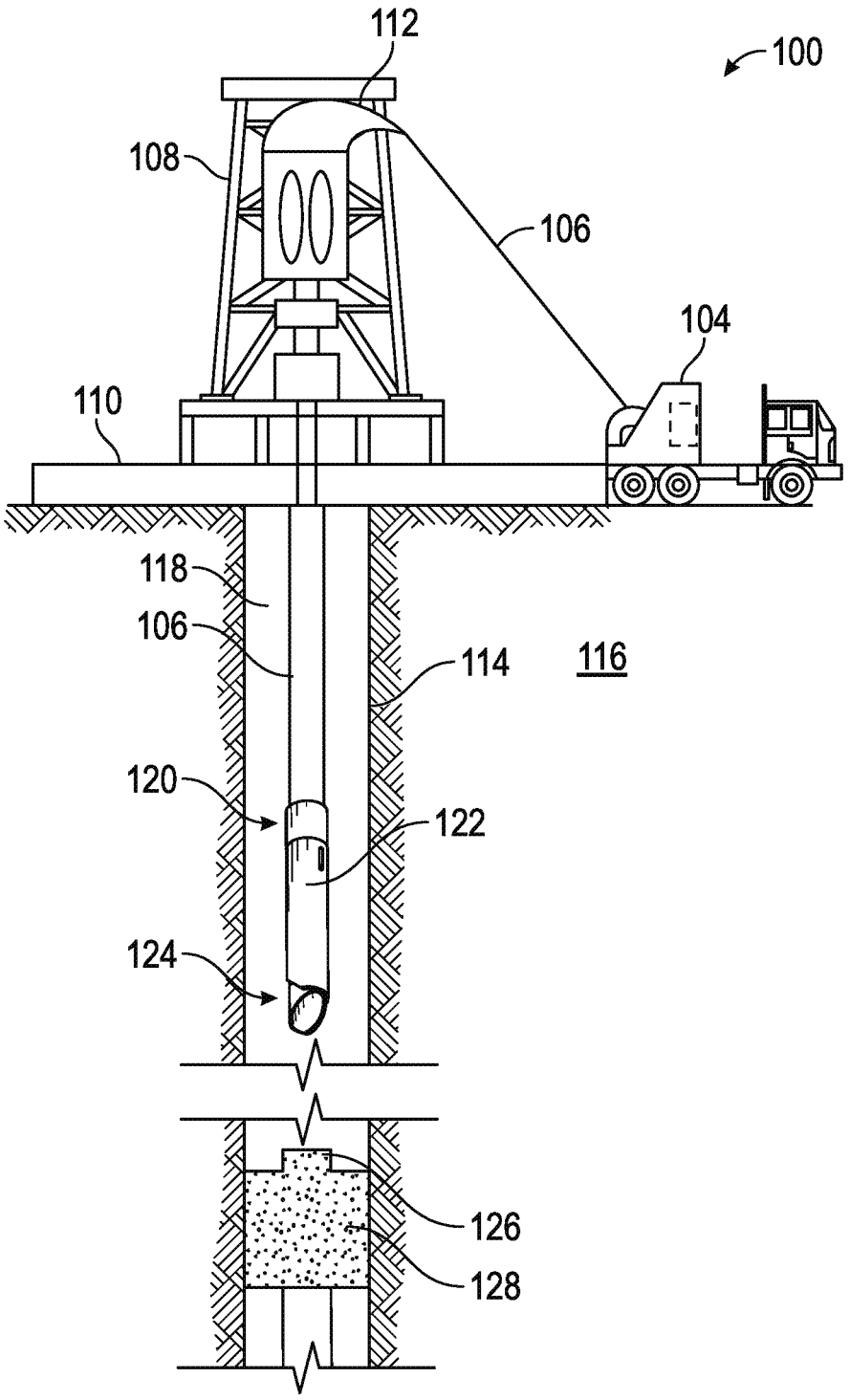
FIG. 1 is a schematic diagram of a drilling environment having a guide according to one example of the present disclosure.

Various embodiments of the disclosure are discussed in details below. While specific implementations are discussed, it should be understood that this is done for illustration purposes only. A person skilled in the relevant art will recognize that other components and configurations may be used without parting from the spirit and scope of the disclosure. Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

Various downhole tools, such as packers, may be provided downhole which may require activation or retrieval from the wellbore to the surface. Tubulars, such as production tubulars, may be inserted from the surface into the wellbore to engage such downhole tools or to withdraw them to the surface. Modern wellbores often involve controls and communication systems which are transmitted through control lines passing through such tubulars. The control lines may extend lengthwise through multiple tubulars which may be joined together in a tubular string. However, when running such tubulars into the wellbore, many times the ability to rotate the tubular strings is not possible due to such control lines becoming entangled, and/or because of extreme borehole angles from drilling or present in deviates wells. Such control lines can prevent or inhibit rotation of the tubulars.

Disclosed herein is a guide which facilitates the engagement of a tubular string from the surface with a downhole tool. Engagement is facilitated even in the absence of rotation of the tubular string. The guide may include a first and second sleeve, which may correspondingly be inner and outer sleeves each slidable relative the other. Each of the sleeves is attached at their uphole end to the tubular string and each have a downhole end having a slanted face. The slanted faces are oriented in different circumferential directions and may face in opposite directions. A hydraulic chamber is formed in and/or between each of the sleeves and which are in fluid communication with one another. The hydraulic chambers permit a transition between a first and second configuration. Namely, when the first or second of the sleeves engages a surface, such as the side of a downhole tool (such as a packer), the force experienced at the downhole end causes the abutting sleeve to retract upward. This upward retracting movement causes force to be transmitted through the compressed fluid in the hydraulic chambers to simultaneously to move and extend the other of the sleeves downward.

Therefore, as one of the sleeves is retracted upward, the other is extended downward, and vice versa. Regardless of which of the sleeves is moved upwards, the compressed fluid will act to push the other sleeve downward. Further, as a sleeve is retracted upward, the slanted face of the sleeve extended downward is revealed. Given that the faces of each of the sleeves face a different circumferential direction, the face of the extended sleeve will be oriented in the proper circumferential direction to slide against the edge of the downhole tool rather than becoming lodged on the downhole tool. As a result, no rotation of the tubular string is needed, nor is any spring required.

FIG. 1 illustrates a wellbore operating environment 100 for engaging a guide with a downhole tool according to the present disclosure. As depicted in FIG. 1, the operating environment 100 includes a wellbore 114 that penetrates a subterranean formation 116. The wellbore 114 may extend substantially vertically away from the Earth's surface as shown or in alternative operating environments, portions or substantially all of the wellbore 114 may be vertical, deviated, horizontal, and/or curved. As illustrated, a servicing rig disposed at the surface includes a derrick 108 with a rig floor 110 through which a wellbore tubular 106 is inserted into the wellbore 114. The wellbore tubular may be any tubular including coiled tubing, segmented tubing string, jointed tubing string, or any other suitable conveyance, or combinations thereof). The wellbore tubular 106 may be drawn from a wellbore servicing unit 104 to the derrick 108 via gooseneck 112. The wellbore tubular 106 extends within the wellbore 114 forming an annulus 119 between the external surface of the wellbore tubular 106 and the walls of the wellbore 114 which may have a casing cemented thereon.

As further shown in FIG. 1, a guide 122 may be coupled to the wellbore tubular 106 at its uphole end 120. The guide 122 has a downhole end 124 which may engage the downhole tool 128, which in the illustrated embodiment is a packer. The guide 122 may engage the downhole tool 128 via its receiver 126, which here includes an aperture for receiving the guide 122. While a packer is shown, the downhole tool may be any type of downhole tool, including tubulars, logging tools, drilling devices, which may be lodged or stuck in place in the the wellbore 114. Additionally, while the guide 122 is shown coupled with a tubular, the guide 122 may be used with any downhole tool to assist engagement with another downhole tool or device lodged in the wellbore 114.

Figure 2:
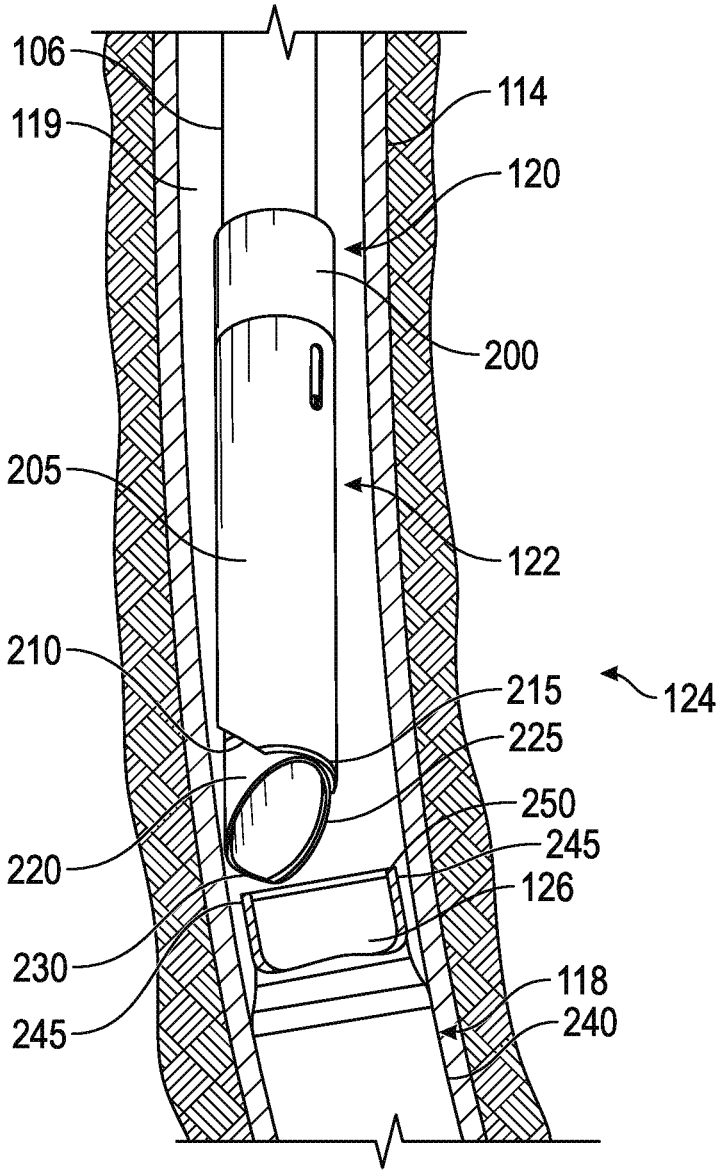
FIG. 2 is a schematic diagram illustrating the guide according to one example of the present disclosure provided in a wellbore.

FIG. 2 is a schematic view of the guide 122 which has been lowered within the wellbore 114 so as to engage the downhole tool 118. As illustrated, this portion of the wellbore 114 is curved and has a casing 140 cemented thereon. The downhole tool 118 has packer element 240 pressed against the casing 140 thereby lodging it in place within the wellbore 114. The guide 122 has a tubular body 200 which couples with the wellbore tubular 106 at the uphole end 120 of the guide 122. The guide 122 further has a first and second sleeve coupled with the tubular body 200, which are illustrated in the depicted embodiment in FIG. 2 as an inner sleeve 220 and an outer sleeve 205, where each is slideable relative to one another. The inner sleeve 220 is positioned within the outer sleeve 205. While illustrated as inner and outer sleeves 220, 205, in other embodiments two sleeves may be employed which are not be placed one within the other, and instead may take other configurations, such as each surrounding a portion of the tubular body 200 without overlapping. The outer sleeve 205 has a slanted face 210 which forms a nose 215 at an end. Similarly, inner sleeve 220 has a slanted face 225 and a nose 230 at its end.

FIG. 2 illustrates the guide 122, at its downhole end 124, abutting against a lip 245 of the receiver 126 on the upper surface 250 of the downhole tool 118, where the receiver 126 includes an aperture. As illustrated, the receiver 126 is substantially centered with respect to the wellbore 114. However, the guide 122 has entered along the side of the wellbore 114 rather than being centered for a perfect insertion into the receiver 126. As illustrated, the guide 122 may be oriented such that the lowermost slanted face, in this case slanted face 225, is not facing an appropriate direction for sliding against the lip 245. Instead, the nose 230 abuts against an upper surface 250 of the downhole tool 118. In such a case, conventional guides may become lodged against the upper surface of a downhole tool and require rotation if possible so as to re-orient a slanted face. However, the guide 122, due to the relative retraction and projection of the inner and outer sleeves 120, 105, is able to present a slanted face in an appropriate direction so as to slide against a lip 245 or other portion of upper surface 250. Accordingly insertion into the receiver 126 for engagement thereof, even in the absence of rotation or use of a spring is allowed.

Figure 3A:
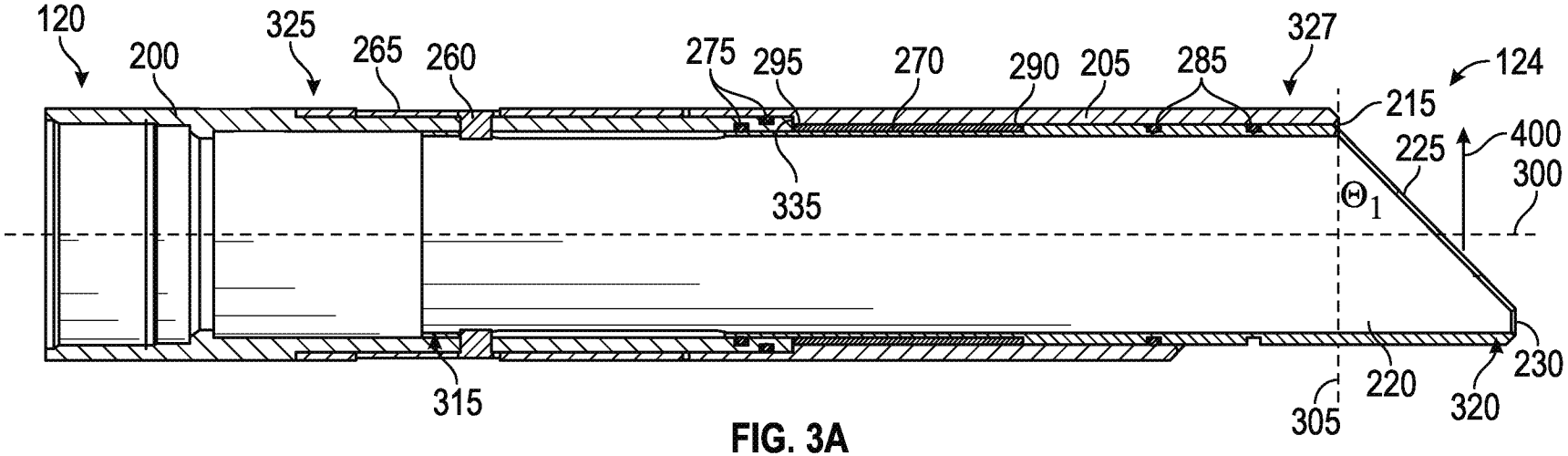
FIG. 3A illustrates the guide according to one example of the present disclosure in a first configuration with one of its sleeves extended and the other retracted.
Figure 3B:
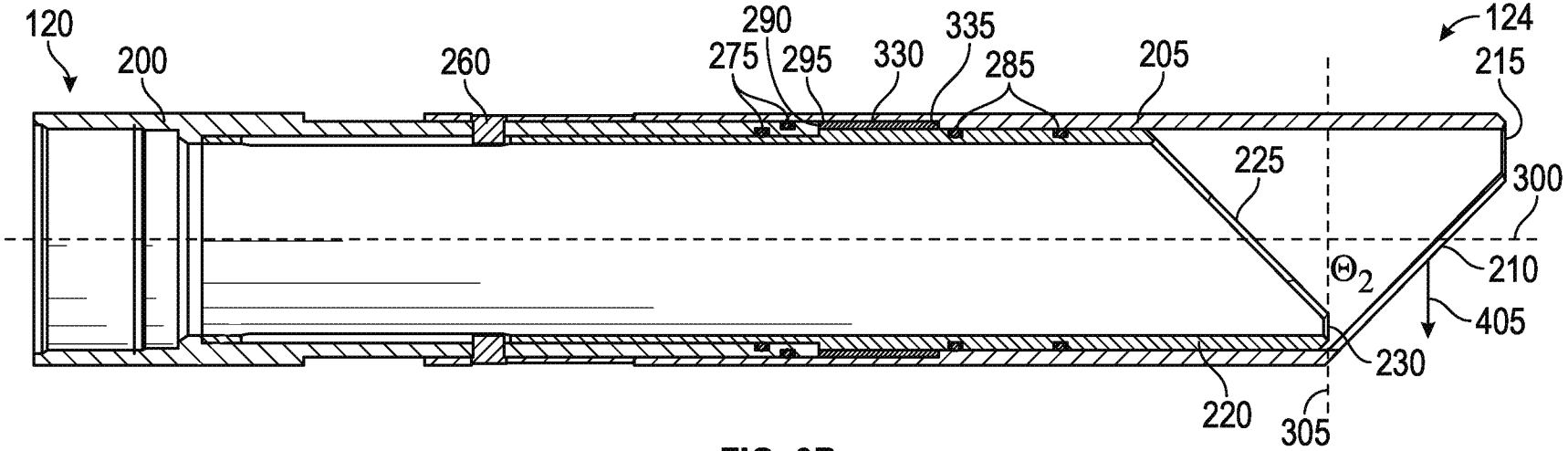
FIG. 3B illustrates the guide according to one example of the present disclosure in a second configuration with the sleeve which is extended in FIG. 3A now retracted, and the sleeve retracted in FIG. 3A now extended.

FIG. 3A illustrates the guide in a first configuration where inner sleeve 220 is extended and outer sleeve 205 retracted, and FIG. 3B illustrates a second configuration where the outer sleeve 205 is extended and the inner sleeve 220 is retracted. The guide 122 is transitionable between each of these configurations, so as to extend one of the slanted faces 225 or 210 against an upper surface of a downhole device 118 and slide the guide 122 into the receiver 126.

FIG. 3A illustrates the inner sleeve 220 slideably coupled with the tubular body 200 at its uphole end 315 and having the slanted face 225 at its downhole end 320. The outer sleeve 205 is also slideably coupled with the tubular body 200 at its uphole end 325 and having the slanted face 210 at its downhole end 327. A central flowbore 250 extends through the guide 122, including the tubular body 200 and inner and outer sleeves 220, 205. An anti-rotation pin 260 extends within an anti-rotation slot 265 through the outer sleeve 205 and further extends through the tubular body 200 and the inner sleeve 220 thereby preventing rotation. While the anti-rotation pin 260 restricts rotation of these aforementioned components, the anti-rotation slot 265 extends longitudinally along the length of the outer sleeve 205 thereby permitting movement of the outer sleeve 205 in a longitudinal direction.

As shown in FIG. 3A, the inner sleeve 220 has a slanted face 225 which is at an angle $\Theta_1$ with respect to a plane 305 which is perpendicular to an axis 300 of the guide 122. This angle $\Theta_1$ may be about 20 to about 60 degrees, alternatively about 30 degrees to about 55 degrees, or about 45 degrees. The angle $\Theta_1$ should be slanted such so that when the slanted face 225 abuts an upper surface 250 of the downhole tool 118 it slides downward into the receiver 126. A circumferential direction 400 is shown by the arrow (discussed in more detail below in FIG. 5), determined by the direction in which the slanted face 225 is pointed.

In the first configuration, as shown in FIG. 3A, inner sleeve 220 is shown in an extended position with its slanted face 225 extending beyond the lowest portion of the outer sleeve 205, in this case the tip of the nose 215 of the outer sleeve 205. In additional embodiments, at least a portion of the slanted face 225 extends beyond the lowest portion of the outer sleeve 205. The base of the slanted face 225 may be placed proximate the nose 215 of the outer sleeve 205. In this position, the slanted face 225 is revealed so that it may slide against an upper surface 250 of the downhole tool 118. A hydraulic chamber 270, containing a hydraulic fluid, is formed within the inner sleeve 220, and bounded by lower shoulder 290 of the inner sleeve 220, an edge 295 of the tubular body 200 and the outer sleeve 205. The lower shoulder 335 of the outer sleeve 205 abuts against the edge 295. Upper seals 275 and lower seals 285 prevent the flow of hydraulic fluid above and below their placement, and which may be O-rings or other conventional seals.

Upon a sufficient force experienced on the nose 230 or slanted face 225, the inner sleeve 220 will undergo an upward retracting movement. This causes a force to be transmitted through the compressed fluid within the hydraulic chamber 270 imposed by the lower shoulder 290. As the inner sleeve 220 retracts upward, the compressed fluid will transmit force against the lower shoulder 335 of the outer sleeve 205, thereby causing the outer sleeve 205 to extend downward as illustrated in FIG. 3B. Therefore, as the inner sleeve 220 sleeve is retracted upward, the outer sleeve 205 is extended downward.

Referring now to FIG. 3B, which illustrates the second configuration, with the outer sleeve 205 extended downward, a hydraulic chamber 330 is revealed which is formed within the outer sleeve 205, and bounded by a lower shoulder 335 of the outer sleeve 205, and edge 295 of the tubular 200 and the inner sleeve 220. The lower shoulder 290 of the inner sleeve 220 abuts against the edge 295. As the outer sleeve 205 extends downward, the hydraulic chamber 330 enlarges while the hydraulic chamber 270 diminishes. Each of the hydraulic chamber 270 and hydraulic chamber 330 are in fluidic communication with one another and together form a common hydraulic chamber. Further, in this configuration, the slanted face 210 extends beyond the lowest portion of the inner sleeve 220, in this case the tip of the nose 230 of the inner sleeve 220. In additional embodiments, at least a portion of the slanted face 210 extends beyond the lowest portion of the inner sleeve 220. The base of the slanted face 210 may be placed proximate the nose 230 of the inner sleeve 220.

The outer sleeve 205 has a slanted face 210 which is at an angle $\Theta_2$ with respect to a plane 305 which is perpendicular to an axis 300 of the guide 122. This angle $\Theta_2$ may be about 20 to about 60 degrees, alternatively about 30 degrees to about 55 degrees, or about 45 degrees. The angle $\Theta_2$ of the slanted face 210 should such that when the abutting an upper surface 250 of the downhole tool 118 slides downward into the receiver 126. A circumferential direction 405 shown by the arrow (discussed in more detail below in FIG. 5) is determined by the direction in which the slanted face 210 is pointed. The circumferential direction 400 of slanted face 225 and the circumferential direction 405 of slanted face 210 are oriented to face different circumferential directions.

Upon a sufficient force experienced on the nose 215 or slanted face 210, the outer sleeve 205 will undergo an upward retracting movement. This causes a force to be transmitted through the compressed fluid within the hydraulic chamber 330 imposed by the lower shoulder 335. As the outer sleeve 205 retracts upward, the compressed fluid will transmit force against the lower shoulder 290 of the inner sleeve 220, thereby causing the inner sleeve 220 to extend downward as illustrated in FIG. 3A. As the inner sleeve 220 extends downward, the hydraulic chamber 330 diminishes while the hydraulic chamber 270 enlarges. In this way, the guide and inner sleeve 220 and outer sleeve 205 transitions between the first and second configurations to reveal a different slanted face.

Figure 4A:
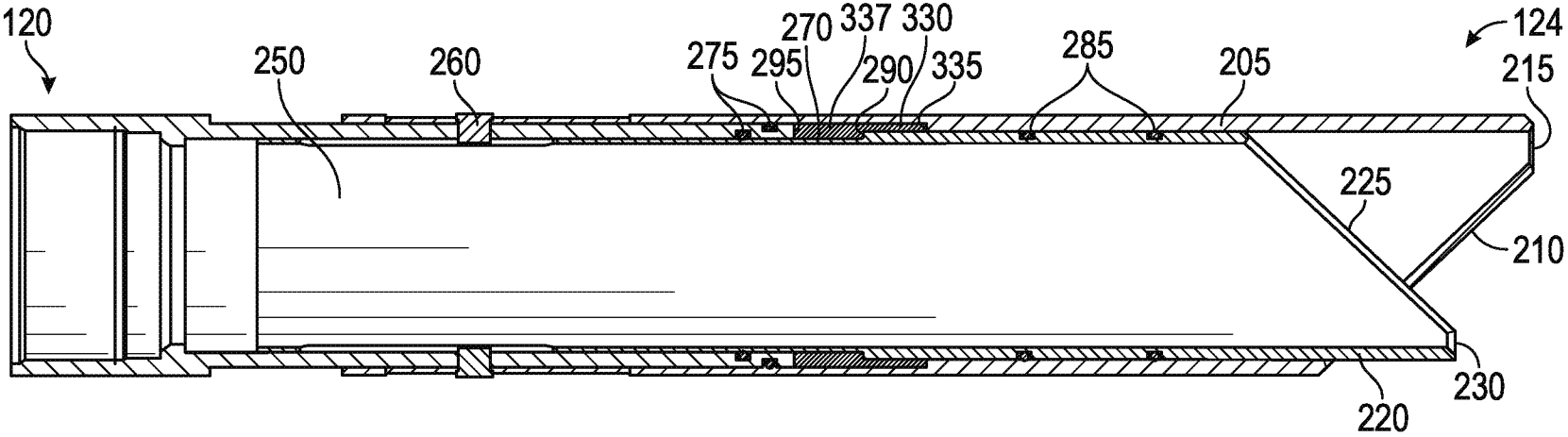
FIG. 4A illustrates the guide according to one example of the present disclosure in a transitional configuration between the first and second configurations.
Figure 4B:
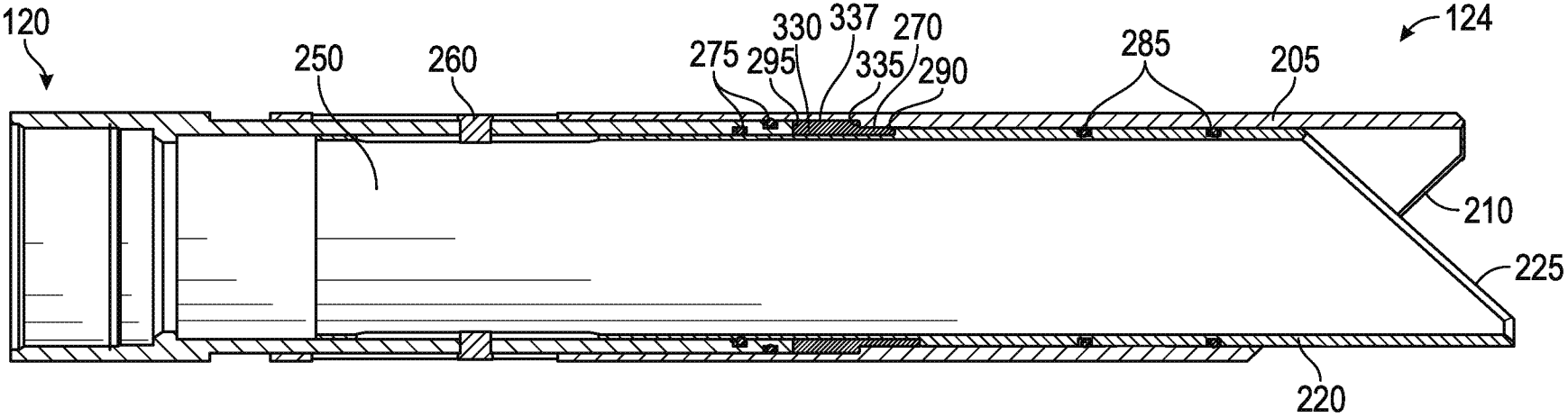
FIG. 4B illustrates the guide according to one example of the present disclosure in a transitional configuration between the first and second configurations.

FIG. 4A and FIG. 4B illustrate the inner and outer sleeves 220, 205 in transitional configurations between the first and second configurations shown in FIGS. 3A and 3B. In particular, FIG. 4A illustrates a transitional configuration where the outer sleeve 205 is extended further out than the inner sleeve 205. For instance, the nose 215 of the outer sleeve 205 is extended further out than the nose 230 of the inner sleeve 230. In such a case the hydraulic chamber 270 of the inner sleeve 205 and the hydraulic chamber 330 together form a common hydraulic chamber 337. FIG. 4B illustrates a transitional configuration where the outer sleeve 205 is extended further out than the inner sleeve 205. For instance, the nose 230 of the inner sleeve 2220 is extended further out than the nose 215 of the outer sleeve 205. Again, the hydraulic chamber 270 of the inner sleeve 205 and the hydraulic chamber 330 together form a common hydraulic chamber 337.

Figure 5:
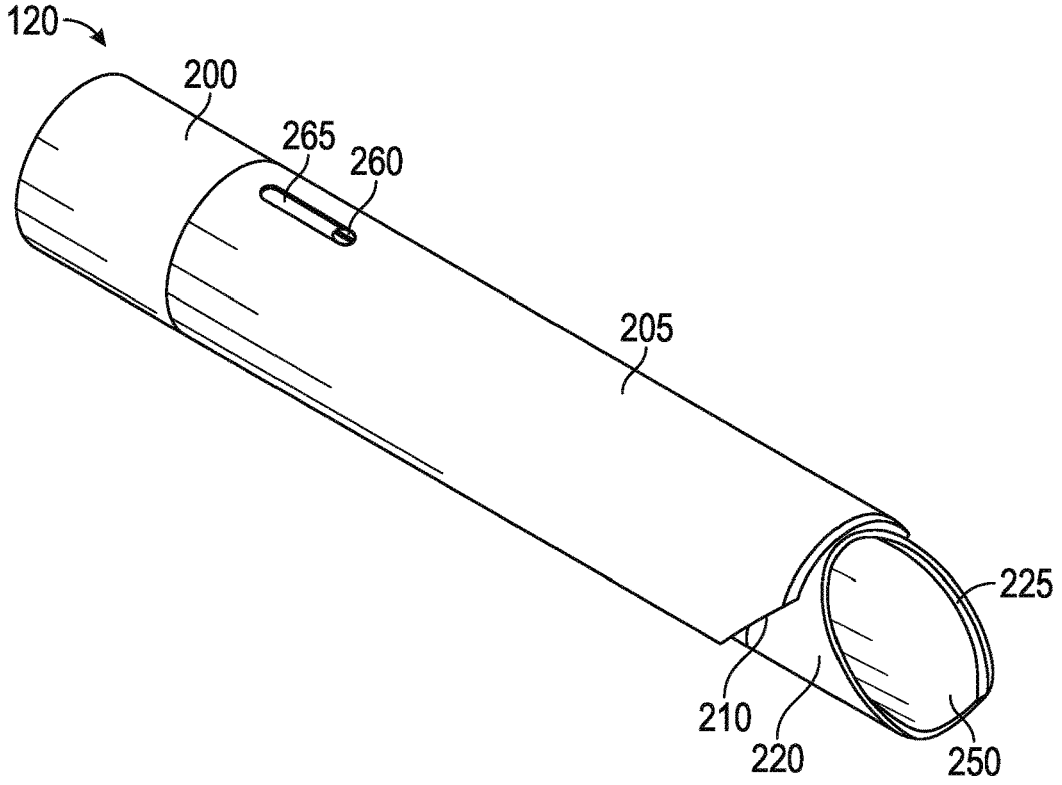
FIG. 5 illustrates a perspective view of guide according to one example of the present disclosure.

FIG. 5 illustrates a perspective view of guide 122. As shown the anti-rotation slot 265 is provided within the outer sleeve 205 and runs longitudinally along the length of the outer sleeve 205 thereby permitting the outer sleeve 205 to move longitudinally uphole and downhole but preventing rotational movement. The anti-rotation pin 260 extends additionally through the tubular 200 and the inner sleeve 220 thereby also restricting rotational movement of these components.

Figure 6:
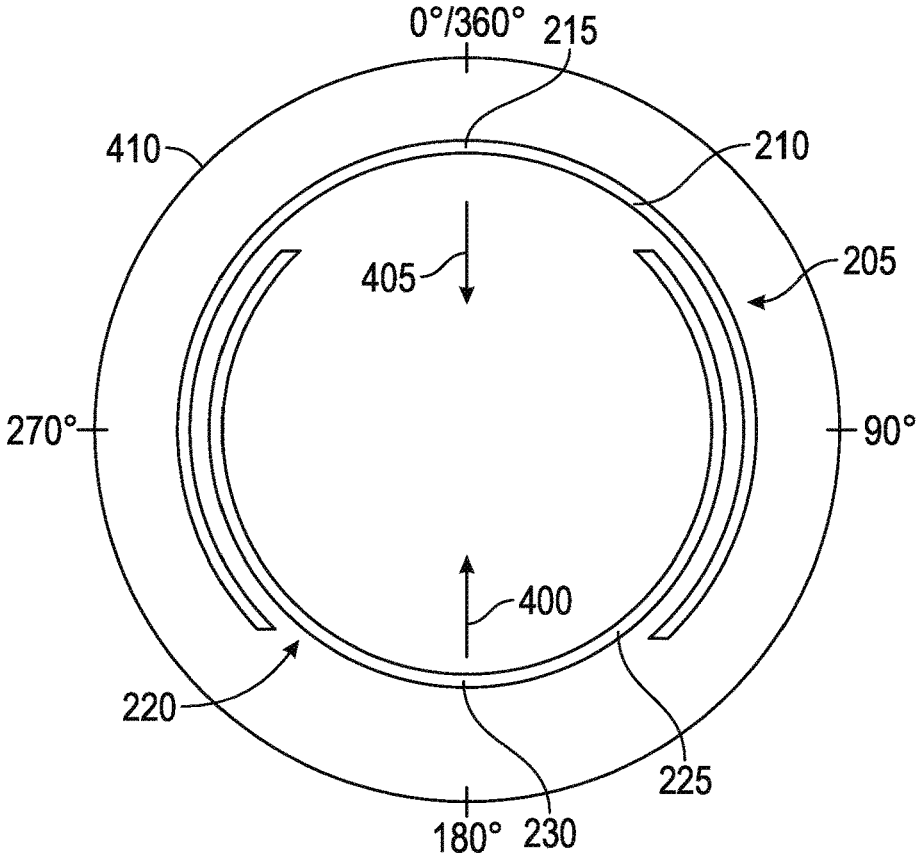
FIG. 6 depicts a simplified schematic overhead plan view of the downhole end of the guide according to one example of the present disclosure.

FIG. 6 depicts a simplified schematic overhead plan view of the downhole end 124 of guide 122 and illustrates the relative circumferential direction of each of the slanted faces 210 and 225 of the outer sleeve 205 and inner sleeve 220 respectively. In particular, directions are shown via the directional circle 410 with 0 degrees at the top with, 90 degrees on the right of the circle, 180 degrees at the bottom of the circle, and 270 degrees on the left of the circle. These degree values are shown merely as exemplary, and any degree values or modes of showing direction can be used. The circumferential direction 400 of slanted face 210 is shown facing (or pointing) toward 180 degrees in the opposite circumferential direction 405 of slanted face 225 which faces (or points) toward 0 degrees. Accordingly, in such an orientation, the slanted faces 210, 225 face toward one another and in opposite directions such that if one of the inner or outer sleeves 220, 205 becomes lodged, the other will extend and present one of the slanted faces 210, 225 which is conducive for sliding against an upper surface into an aperture of a downhole tool. While slanted face 210 faces 180 degrees and slanted face 225 faces 0 degrees, each can be reoriented to face any of the degrees 0 to 360 (around the entire directional circle 410), as long as the slanted faces 210, 225 face in different circumferential directions.

Numerous examples are provided herein to enhance understanding of the present disclosure. A specific set of statements are provided as follows.

Statement 1: A guide comprising: a tubular body; a first sleeve and second sleeve each having an uphole end coupled with the tubular body and a downhole end having a slanted face, each of the first and the second sleeves slideable relative to one another, the slanted face of each of the first sleeve and the second sleeves oriented facing different circumferential directions; and a hydraulic chamber formed between each of the first and second sleeves and containing a hydraulic fluid, the first and second sleeves transitionable between a first configuration and a second configuration based on a force transmitted through the hydraulic chamber, wherein in the first configuration the downhole end of the second sleeve is extended beyond the downhole end of the first sleeve, and in the second configuration the downhole end of the first sleeve is extended beyond the downhole end of the second sleeve.

Statement 2: The guide of Statement 1, wherein the transitioning from the first configuration to the second configuration occurs upon a force experienced at the downhole end of the first sleeve transmitted via the hydraulic chamber to extend the downhole end of the second sleeve beyond the downhole end of the first sleeve, and the transitioning from the second configuration to the second configuration occurs upon a force experienced at the downhole end of the second sleeve transmitted via the hydraulic chamber to extend the lower end of the first sleeve beyond the lower end of the second sleeve.

Statement 3: A guide according to Statements 1 or 2, wherein during the transition from the first configuration to the second configuration, the first sleeve extends away from tubular body and the second sleeve simultaneously retracts toward the tubular body, and during the transition from the second configuration to the first configuration, the second sleeve extends away from tubular body and the first sleeve simultaneously retracts toward the tubular body.

Statement 4: A guide according to any one of the preceding Statements 1-3, wherein the first sleeve is an inner sleeve and the second sleeve is an outer sleeve, wherein the inner sleeve positioned within the outer sleeve.

Statement 5: A guide according to any one of the preceding Statements 1-4, wherein the hydraulic chamber comprises a hydraulic chamber formed in each of the first and second sleeves in fluidic communication with one another.

Statement 6: A guide according to any one of the preceding Statements 1-5, wherein the hydraulic chamber formed in each of the first and second sleeves has a shoulder which exerts force against the fluid within the hydraulic chamber during the transitioning from the first configuration to the second configuration.

Statement 7: A guide according to any one of the preceding Statements 1-6, wherein the tubular body comprises an anti-rotation slot that extends longitudinally along the length of the tubular body, the guide further comprising a pin extending from within the slot and through the first and second sleeves.

Statement 8: A guide according to any one of the preceding Statements 1-7, wherein the slanted face of each of the first and second sleeves is slanted at an angle of between about 20 to about 60 degrees with respect to a plane perpendicular to an axis of the tubular body.

Statement 9: A guide according to any one of the preceding Statements 1-8, wherein the slanted faces of each of the first and second sleeves face toward one another.

Statement 10: A guide according to any one of the preceding Statements 1-9, wherein the slanted faces of each of the first and second sleeves are rotated about 180 degrees with respect to one another.

Statement 11: A system comprising, a tubular body disposed in a well bore; a first sleeve and second sleeve each disposed in a wellbore, and having an uphole end coupled with the tubular body and a downhole end having a slanted face, each of the first and the second sleeve slideable relative to one another, the slanted face of each of the first sleeve and the second sleeve oriented facing different circumferential directions; and a hydraulic chamber formed between each of the first and second sleeves and containing a hydraulic fluid, the first and second sleeves transitionable between a first configuration and a second configuration based on a force transmitted through the hydraulic chamber, wherein in the first configuration the downhole end of the second sleeve is extended beyond the downhole end of the first sleeve, and in the second configuration the downhole end of the first sleeve is extended beyond the downhole end of the second sleeve.

Statement 12: The system of Statement 11, wherein the transitioning from the first configuration to the second configuration occurring upon a force experienced at the downhole end of the first sleeve transmitted via the hydraulic chamber to extend the downhole end of the second sleeve beyond the downhole end of the first sleeve, and the transitioning from the second configuration to the first configuration occurring upon a force experienced at the downhole end of the second sleeve transmitted via the hydraulic chamber to extend the lower end of the first sleeve beyond the lower end of the second sleeve.

Statement 13: The system of Statement 11 or 12, wherein the first sleeve is an inner sleeve and the second sleeve is an outer sleeve, wherein the inner sleeve resides within the outer sleeve.

Statement 14: The system according to any one of the preceding Statements 11-13, wherein the slanted face of each of the first and second sleeves is slanted at an angle of between about 20 to about 60 degrees with respect to a plane perpendicular to an axis of the tubular body.

Statement 15: The system according to any one of the preceding Statements 11-14, wherein the slanted faces of each of the first and second sleeves face toward one another.

Statement 16: The system according to any one of the preceding Statements 11-15, wherein the tubular body comprises an anti-rotation slot that extends longitudinally along the length of the tubular body, the guide further comprising a pin extending from within the slot and through the first and second sleeves.

Statement 17: A method for inserting a guide into a downhole tube comprising: inserting a tubular string into a wellbore, the tubular string having a guide on an end thereof, the guide having an first sleeve and second sleeve each having an uphole end coupled with a tubular body coupled with the tubular string and a downhole end having a slanted face, each of the first and the second sleeve slideable relative to one another, the slanted face of each of the first sleeve and the second sleeve oriented facing different circumferential directions; and a hydraulic chamber formed between each of the first and second sleeves and containing a hydraulic fluid, the first and second sleeves transitionable between a first configuration and a second configuration based on a force transmitted through the hydraulic chamber, wherein in the first configuration the downhole end of the second sleeve is extended beyond the downhole end of the first sleeve, and in the second configuration the downhole end of the first sleeve is extended beyond the downhole end of the second sleeve.

Statement 18: The method of Statement 17 further comprising: transitioning from the first configuration to the second configuration occurring upon a force experienced at the downhole end of the first sleeve transmitted via the hydraulic chamber to extend the downhole end of the second sleeve beyond the downhole end of the first sleeve, and transitioning from the second configuration to the first configuration occurring upon force experienced at the downhole end of the second sleeve transmitted via the hydraulic chamber to extend the lower end of the first sleeve beyond the lower end of the second sleeve.

Statement 19: The method of Statement 17 or 18 further comprising inserting the guide into a downhole tool.

Statement 20: The method according to any one of the preceding Statements 17-19, wherein the hydraulic chamber formed in each of the first and second sleeves has a shoulder which exerts force against the fluid within the hydraulic chamber during the transitioning from the first configuration to the second configuration.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A guide comprising:

a tubular body;

a first sleeve and second sleeve each having an uphole end coupled with the tubular body and a downhole end having a slanted face, wherein each of the first and the second sleeves are configured to slide relative to one another based on motion of a hydraulic fluid and application of a force; and a hydraulic chamber formed between each of the first and second sleeves and containing the hydraulic fluid, the hydraulic chamber including a first section and a second section, wherein:

the first and second sleeves transition between a first configuration and a second configuration based on the force being transmitted through the hydraulic chamber when the force is applied at the downhole end of the first sleeve, wherein the application of the force at the downhole end of the first sleeve results in the first section of the hydraulic chamber diminishing in size as the second section of the hydraulic chamber enlarges in size until the second sleeve extends beyond the downhole end of the first sleeve, and the first and second sleeves transition between the second configuration and the first configuration when the force is applied at the downhole end of the second sleeve to extend the downhole end of the first sleeve beyond the downhole end of the second sleeve.

2. A guide according to claim 1 wherein during the transition between the first configuration and the second configuration, the first sleeve extends away from tubular body and the second sleeve simultaneously retracts toward the tubular body, and during the transition between the second configuration and the first configuration, the second sleeve extends away from tubular body and the first sleeve simultaneously retracts toward the tubular body.

3. A guide according to claim 1, wherein the first sleeve is an inner sleeve and the second sleeve is an outer sleeve, and the inner sleeve positioned within the outer sleeve.

4. A guide according to claim 1, wherein the first section and the second section of the hydraulic chamber are in fluidic communication with one another.

5. A guide according to claim 4, wherein the first and second sleeves each have a shoulder which transmits the force through the hydraulic fluid within the hydraulic chamber during the transitioning from the first configuration to the second configuration.

6. A guide according to claim 1, wherein:

the tubular body comprises an anti-rotation slot that extends longitudinally along a length of the tubular body, and the guide further comprising a pin extending from within the anti-rotation slot and through the first and second sleeves.

7. A guide according to claim 1, wherein the slanted face of each of the first and second sleeves is slanted at an angle of between 20 to 60 degrees with respect to a plane perpendicular to an axis of the tubular body.

8. A guide according to claim 1, wherein the slanted face of each of the first and second sleeves face toward one another.

9. A guide according to claim 1, wherein the slanted face of each of the first and second sleeves are oriented at an angle of 180 degrees with respect to one another.

10. A system comprising, a tubular body disposed in a well bore;

a first sleeve and second sleeve each disposed in a wellbore, and having an uphole end coupled with the tubular body and a downhole end having a slanted face, each of the first and the second sleeves slide relative to one another based on motion of a hydraulic fluid and application of a force; and a hydraulic chamber formed between each of the first and second sleeves and containing the hydraulic fluid, the hydraulic chamber including a first section and a second section, wherein:

the first and second sleeves transition between a first configuration and a second configuration based on the force being transmitted through the hydraulic chamber when the force is applied at the downhole end of the first sleeve, wherein the application of the force at the downhole end of the first sleeve results in the first section of the hydraulic chamber diminishing in size as the second section of the hydraulic chamber enlarges in size until the second sleeve extends beyond the downhole end of the first sleeve, and the first and second sleeves transition between the second configuration and the first configuration when the force is applied at the downhole end of the second sleeve to extend the downhole end of the first sleeve beyond the downhole end of the second sleeve.

11. The system of claim 10, wherein the first sleeve is an inner sleeve and the second sleeve is an outer sleeve, and the inner sleeve resides within the outer sleeve.

12. The system of claim 10, wherein the slanted face of each of the first and second sleeves is slanted at an angle of between 20 to 60 degrees with respect to a plane perpendicular to an axis of the tubular body.

13. The system of claim 10, wherein the slanted face of each of the first and second sleeves face toward one another.

14. The system of claim 10, further comprising:

a pin extending from an anti-rotation slot and through the first and second sleeves, wherein the tubular body comprises the anti-rotation slot that extends longitudinally along a length of the tubular body.

15. A method for inserting a guide into a downhole tube comprising:

inserting a tubular string into a wellbore, the tubular string having the guide on an end thereof, the guide having:

a first sleeve and a second sleeve each having an uphole end coupled with a tubular body coupled with the tubular string and a downhole end having a slanted face, each of the first and the second sleeve configured to slide relative to one another based on motion of a hydraulic fluid and application of a force; and a hydraulic chamber formed between each of the first and second sleeves and containing the hydraulic fluid, the hydraulic chamber including a first section and a second section, wherein:

the first and second sleeves transition between a first configuration and a second configuration based on the force being transmitted through the hydraulic chamber when the force is applied at the downhole end of the first sleeve, wherein the application of the force at the downhole end of the first sleeve results in the first section of the hydraulic chamber diminishing in size as the second section of the hydraulic chamber enlarges in size until the second sleeve extends beyond the downhole end of the first sleeve, and the first and second sleeves transition between the second configuration and the first configuration when the force is applied at the downhole end of the second sleeve to extend the downhole end of the first sleeve beyond the downhole end of the second sleeve.

16. The method of claim 15 further comprising inserting the guide into a downhole tool.

17. The method of claim 15, wherein the hydraulic chamber formed in each of the first and second sleeves has a shoulder which transmits the force through the hydraulic fluid within the hydraulic chamber during the transitioning from the first configuration to the second configuration.

* * * * *